US005172634A

United States Patent [19]

Iwamoto

[11] Patent Number: 5,172,634

[45] Date of Patent: Dec. 22, 1992

[54] INTERMEDIATE CYLINDER OF SHEET-FEED PRESS

[75] Inventor: Masayuki Iwamoto, Shizuoka, Japan

[73] Assignee: Shinohara Machinery Co., Ltd., Shizuoka, Japan

[21] Appl. No.: 901,262

[22] Filed: Jun. 19, 1992

[51] Int. Cl.[5] ..... B21F 1/30

[52] U.S. Cl. ..... 101/410; 271/82; 271/277; 101/232

[58] Field of Search ..... 101/408, 409, 410, 411, 101/230, 231, 232, 183; 271/82, 277

[56] References Cited

U.S. PATENT DOCUMENTS

| | | | |
|---|---|---|---|
| 2,757,610 | 8/1956 | Gegenheimer et al. | 101/183 |
| 3,443,808 | 5/1969 | Siebue | 271/82 |
| 4,014,261 | 3/1977 | Becker | 101/232 |
| 4,024,814 | 5/1977 | Becker | 101/410 |
| 4,026,209 | 5/1977 | Wirz et al. | 101/231 |
| 4,122,773 | 10/1978 | Wirz | 101/230 |
| 4,204,471 | 5/1980 | Becker | 101/410 |
| 4,367,679 | 1/1983 | Ishii et al. | 101/410 |
| 4,378,734 | 4/1983 | Wirz | 101/410 |
| 4,667,952 | 5/1987 | Jeschke et al. | 101/277 |

*Primary Examiner*—Eugene H. Eickholt
*Attorney, Agent, or Firm*—Ladas & Parry

[57] ABSTRACT

A structure of an intermediate cylinder of a sheet-feed press is disclosed.

The present invention comprises a main shaft 10, a front edge gripper holder 12 formed integrally with the main shaft 10, having a group of front edge grippers 20 aligned in an axial direction, and having an arcuate outer surface section, holding discs 24 disposed at both side portions of the main shaft 10 in such a fashion that the rotation thereof relative to the main shaft 10 can be adjusted, and a rear edge gripper holder 22 having a group of rear edge grippers 28 aligned in the axial direction between the holding discs 24, and having a sheet member 38 disposed similarly on the outer peripheral surfaces between the holding discs 24, having an arcuate section, and partially overlapping the outer surface of the front edge gripper holder 12. With this arrangement it is possible to obtain an intermediate cylinder of a sheet-feed press production and assembly adjustment of which can be made by far more easily, and which does not cause any trouble during delivery of sheet.

1 Claim, 5 Drawing Sheets

INTERMEDIATE CYLINDER OF SHEET-FEED PRESS

BACKGROUND OF THE INVENTION

1. Field of the Invention

This invention relates to a sheet-feed press for printing single side/both sides, and more particularly to a structure of an intermediate cylinder in a sheet transfer system of such a sheet-feed press.

2. Description of the Prior Art

In a sheet-feed press for printing single side/both sides, a plurality of printing units including each plate cylinder, blanket cylinder, impression cylinder and ink arrangement are interconnected by a sheet transfer system referred to as a "double-size intermediate drum system". In other words, the upstream side printing unit and the downstream side printing unit are connected by the sheet transfer system consisting of a sheet transfer cylinder having an equal diameter to that of the plate cylinder of the printing unit, an intermediate cylinder having a diameter twice that of the plate cylinder and a reversing cylinder having a diameter equal to that of the plate cylinder, and the transfer of the sheet and reversing of the sheet necessary at the time of double-side printing are effected.

Accordingly, two sets of front edge grippers for gripping the front edge of the sheet and rear edge grippers for supporting the rear edge of the sheet only during double-side printing, that together form pairs, are provided to the intermediate cylinder in such a manner at to oppose one another with a 180° phase difference between them with respect to a main shaft of the intermediate cylinder as the center. These gripper devices are generally referred to as "A grippers" and "B grippers", respectively.

During one-side printing, the sheet transfer cylinder receives the front edge of the sheet from the upstream side printing unit and delivers its front edge to the front edge grippers of the intermediate cylinder. The front edge grippers of the intermediate cylinder deliver the front edge directly to the grippers of the reversing cylinder at the contact point with the reversing cylinder that follows. Subsequently, the grippers of the reversing cylinder send to the front edge of the sheet to the downstream side unit. As a result, printing is made continuously on one side of the sheet. Incidentally, the rear edge grippers of the intermediate cylinder do not at all play any positive role during this one-side printing, and is substantially at rest.

During double-side printing, on the other hand, the sheet transfer cylinder receives the front edge of the sheet from the upstream side printing unit and lets the front edge grippers of the intermediate cylinder grip the front edge, in the same way as in the case of one-side printing. Subsequently, the rear edge grippers, too, operate, support the rear edge of the sheet and applies expansion and stretch to the rear edge so that the sheet can be wound tightly around the outer periphery of the intermediate cylinder. This is because the rear edge of the sheet becomes the reference for delivery of the sheet to the reversing cylinder in the case of double-side printing. In other words, the front edge grippers pass by the contact point with the reversing cylinder as such while gripping the sheet and when the rear edge grippers arrive at the contact point, the front edge grippers deliver the rear edge of the sheet to the reversing grippers of the reversing cylinder. Then, the reversing cylinder turns over the sheet with its rotation, and delivers the sheet to the downstream side printing unit, so that printing is made to the surface of the sheet opposite to the one printed by the upstream side printing unit.

Since the lengths of the sheets to be transferred are diversified, the position of the rear edge of the intermediate cylinder must be changed with respect to the front edge grippers fixed at predetermined positions, in accordance with the sheet size when double-side printing is carried out.

U.S. Pat. No. 4,204,471 discloses the structure of an intermediate cylinder wherein a rear edge gripper holder is movable and adjustable with respect to a front edge gripper holder in order to adjust the size of the sheet of the intermediate cylinder in double-side printing. In this prior art, the front edge gripper holder 50 and the rear edge gripper holer 52 fit to one another in a comb-shape and define a perfectly circular intermediate cylinder when the outer periphery is viewed as a whole. Here, the term "comb-shape" means the arrangement wherein the outer surface of the front edge gripper holder 50 is notched in a comb-shape and comb-shaped blades 56 of the rear edge gripper holder 52 fit into these notches 54.

However, if the comb-shape is required for both the front edge gripper holder and the rear edge gripper holder, many man-hours are necessary for the production, assembly and adjustment of these components and moreover, if the end portion of the sheet hangs down into the comb-shape notches, a trouble would occur during the sheet delivery.

SUMMARY OF THE INVENTION

In view of the problems described above, the present invention provides an improved intermediate cylinder of a sheet-feed press, and intends to make its production, assembly and adjustment remarkably easier, and prevent any troubles from occurring during delivery of a sheet.

To accomplish the object described above, the intermediate cylinder of a sheet-feed press according to the present invention has the construction which includes a main shaft 10 and a group of front edge grippers 20 formed integrally with the main shaft 10 and aligned in an axial direction, and wherein a front edge gripper holder 12 the outer surface section of which is arcuate and holding discs 24 disposed on both sides of the main shaft are rotatable and adjustable with respect to the main shaft 10, a group of rear edge grippers 28 aligned in the axial direction are disposed between the holding discs 24, and a rear edge gipper holder 22 having a sheet member 38, which is disposed on the outer peripheral surface between the holding discs 24, has an arcuate sectional shape, and partially overlaps the outer surface of the front edge gripper holder 12, is also disposed.

The outer surface of the front edge gripper holder 12 and the sheet member 38 of the rear edge gripper holder 22 together define an outer peripheral surface having a composite arcuate shape between the front edge gripper group 20 and the rear edge gripper group 28, and the sheet is wound around this outer peripheral surface. When the size of the sheet is adjusted during double-side printing, the position of the rear edge gripper group 28 can be changed while maintaining the outer peripheral surface of the composite arcuate shape by rotating the holding discs 24 of the rear edge gripper holder 22 relative to the main shaft 10.

Other objects, etc, of the present invention will become more apparent from the following description taken in connection with the drawings, but they merely illustrate an embodiment of the invention but in no way limitative to the present invention.

DESCRIPTION OF THE PREFERRED EMBODIMENT

Figure 1:
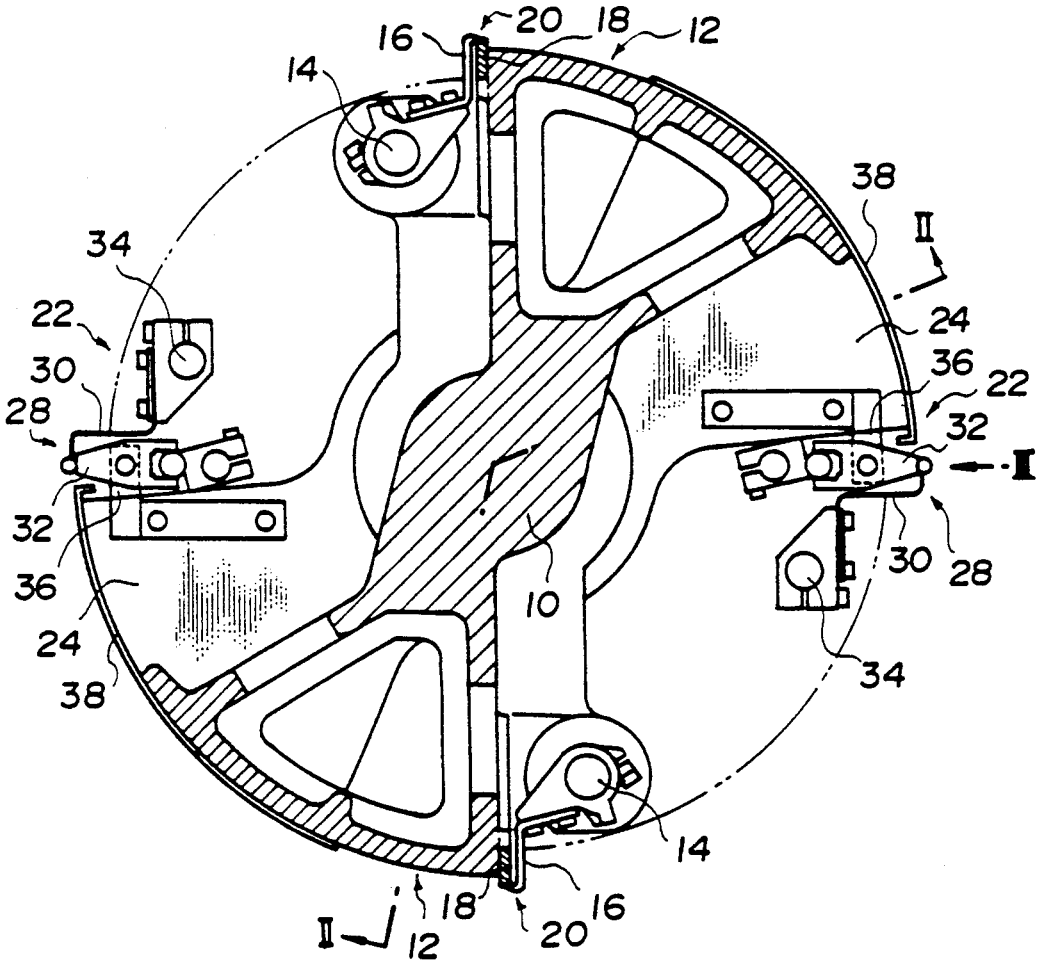
FIG. 1 is a sectional explanatory view showing an embodiment of an intermediate cylinder device of a sheet-feed press according to the present invention.
Figure 2:
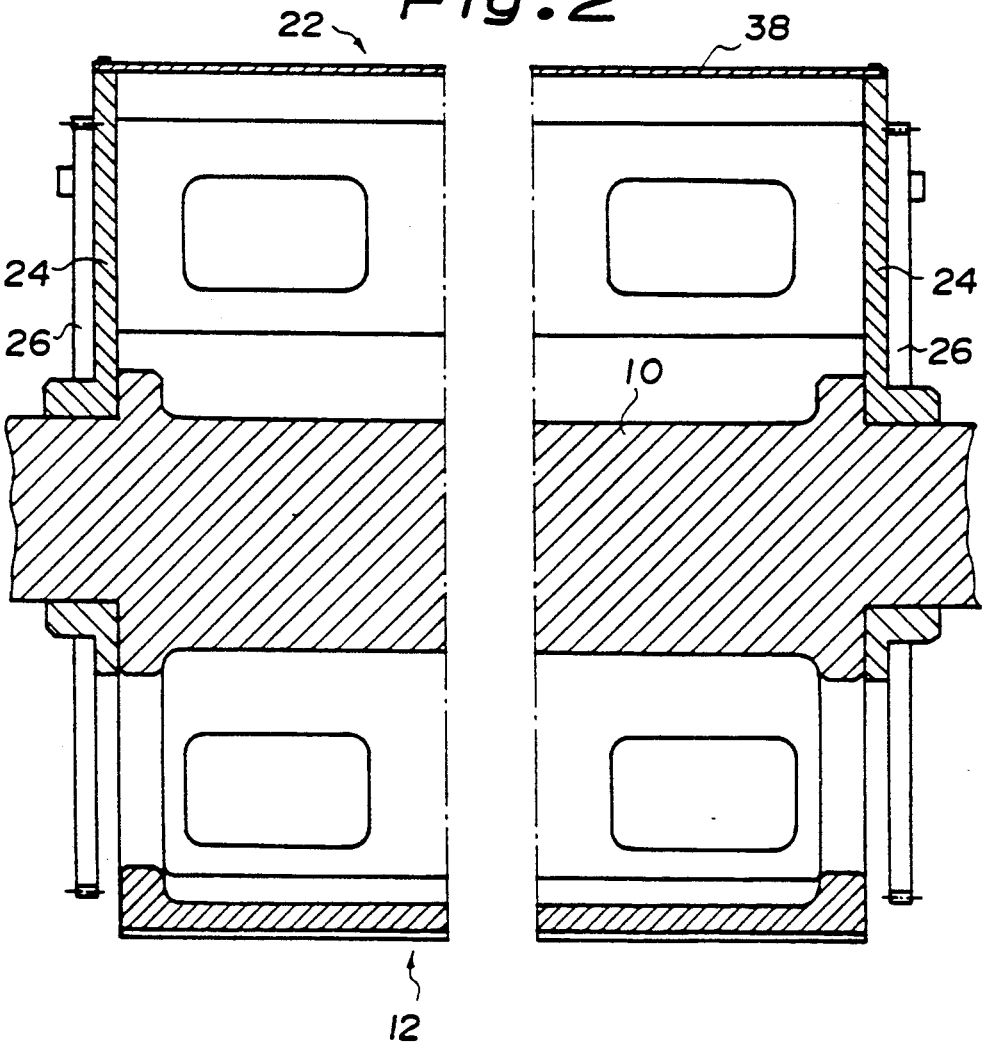
FIG. 2 is a sectional explanatory view in an axial direction when the section is taken along a line II—II in FIG. 1.
Figure 3:
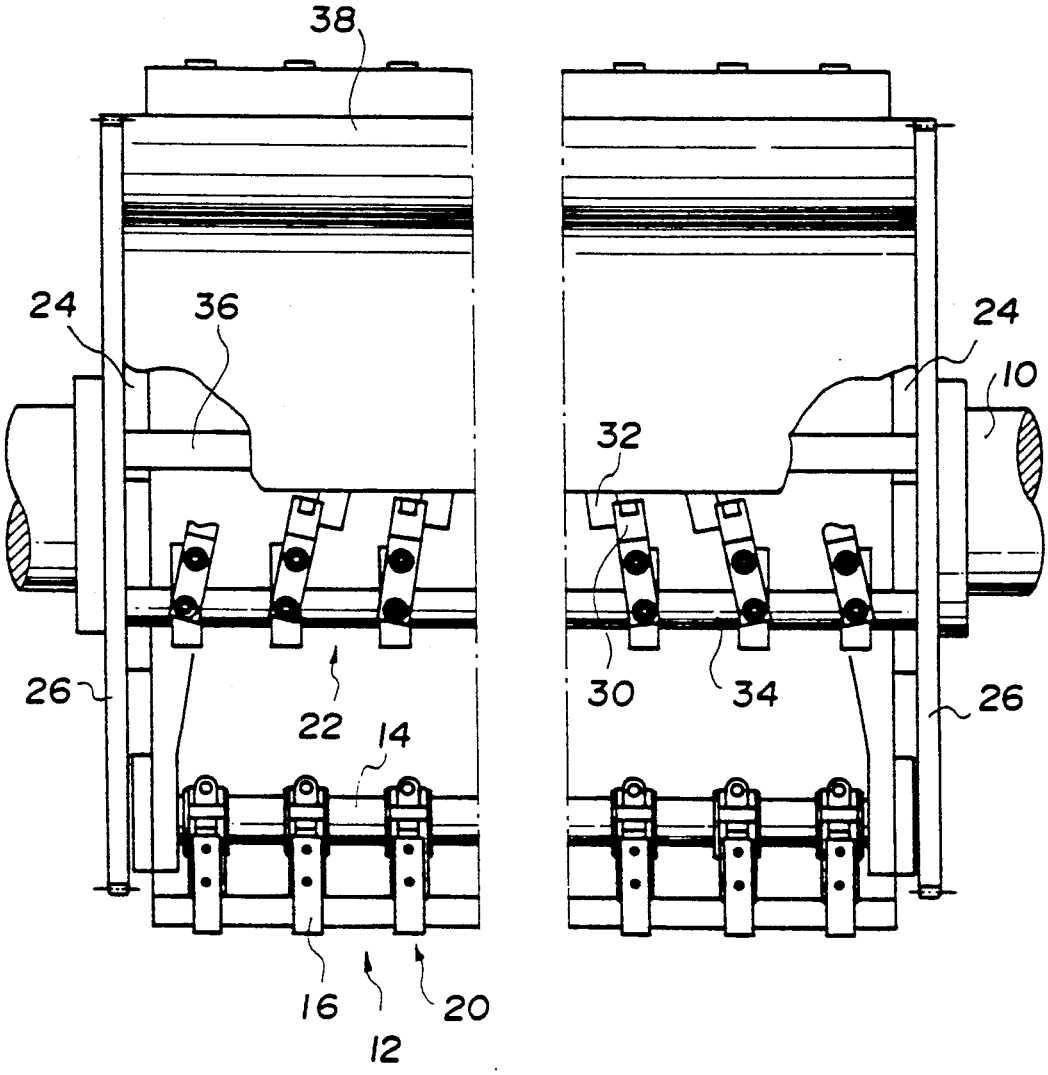
FIG. 3 is a front view in the axial direction when viewed from a direction of an arrow III in FIG. 1.

In the accompanying drawings, reference numeral 10 denotes a main shaft of an intermediate cylinder, and this main shaft 10 is supported between side walls of a printing press and is driven for rotation. Needless to say, gears, etc, are fixed to the shaft end to drive and rotate the main shaft 10, but they are omitted from the drawings.

Two sets of front edge gripper holders 12 are formed by casting integrally with the main shaft 10 and axisymmetrically with one another with their phases being deviated by 180° with respect to the main shaft 10 as the center. In other words, the intermediate cylinder according to the present invention has a diameter double that of a plate cylinder of a printing unit. Since two sets of grippers (A gripper and B gripper) are mounted to one intermediate cylinder, the front edge grippers 12, too, are disposed at two axisymmetrical positions. Although the main shaft 10 and the front edge gripper holders 12 are formed integrally with one another, they are of course hollowed as much as possible so as to reduce their weight.

A front edge gripper group 20 consisting of a large number of grippers 16 fitted in alignment to a front edge gripper shaft 14 extending in an axial direction and gripper pads 18 so fixed as to correspond to these grippers 16 is provided to the front edge gripper holder 12. When the front edge gripper shaft 14 is rotated by a suitable cam mechanism, these grippers 16 are opened or closed altogether with respect to the gripper pads 18 and clamp and release the front edge of a sheet. This structure is well known already. It is noteworthy in the present invention, however, that the clamp surface of the gripper pad 18 slightly protrudes beyond the outer surface of the front edge gripper holder 12, and this protruding clamp surface defines virtually the outer diameter of the intermediate cylinder. (The reasons for this protrusion will be described later.) The sectional shape of the outer surface of the front edge gripper holder 12 is arcuate.

A rear edge gripper holder 22 forming a pair with each front edge gripper 12 uses a holding disc 24 disposed on each side portion of the main shaft 10 as the base. The holding discs 24 are connected to both end portions of the main shaft 10 so that their rotation can be adjusted. When gears 26 integral with the holding discs 24 are rotated by other gears, not shown, the holding discs 24 are rotated with the main shaft 10 being the center, for adjusting the sheet dimension. After this adjsutment, the holding discs 24 are fixed at arbitrary positions of the main shaft 10.

The rear edge gripper group 28 consisting of mechanical means, in this embodiment, is disposed between these holding discs 24. Sheet support members 30 and sheet receiving members 32 corresponding to the grippers 16 and the gripper pads 18 in the front edge gripper group 20, respectively, and forming pairs, are disposed in alignment on a sheet support shaft 34 and a sheet receiving bar 36, respectively. When the sheet support shaft 34 is rotated by a suitable cam mechanism, clamp and release of the rear edge of the sheet are effected. Needless to say, the rear edge gripper group 28 may utilize vacuum.

One sheet member 38 having an arcuate section is intersposed between a pair of holding discs 24. This sheet member 38 consists of a metal sheet having a suitable bending strength, and is fixed to the outer peripheral surface of the holding disc 24 by a bolt, etc. The sheet member 38 having an arcuate section partially superposes with the outer surface of the front edge gripper holder 12 and constitutes a winding surface of the sheet.

As can be understood very easily from the drawings, the sheet winding surface in the apparatus of the present invention is not a perfect circle as has been in the prior art. In other words, the clamp surface of the gripper pad 18 of the front edge gripper holder 12 protrudes from the surface of the front edge gripper holder 12 and the sheet member 38 of the rear edge gripper holder 22, too, covers partially the surface of the front edge gripper holder 12 and leaves a step corresponding to the thickness of the sheet. However, the existence of such a step and the pseudo-composite arc of the overall shape do not render any hindrance to the transfer of the sheet which is the original function of the intermediate cylinder. Because, the intermediate cylinder is involved only in the transfer of the sheet but does not receive any printing pressure. Therefore, its outer periphery need not always be a perfect circle. During the adjustment of the sheet dimension, too, it is only necessary that the rear edge position of the sheet by the rear edge gripper group 28 be definite, and so long as the symmetry of positions of the A gripper and the B gripper is secured, no problem occurs even when the periphery of the intermediate cylinder is not a perfect circle.

Figure 4:
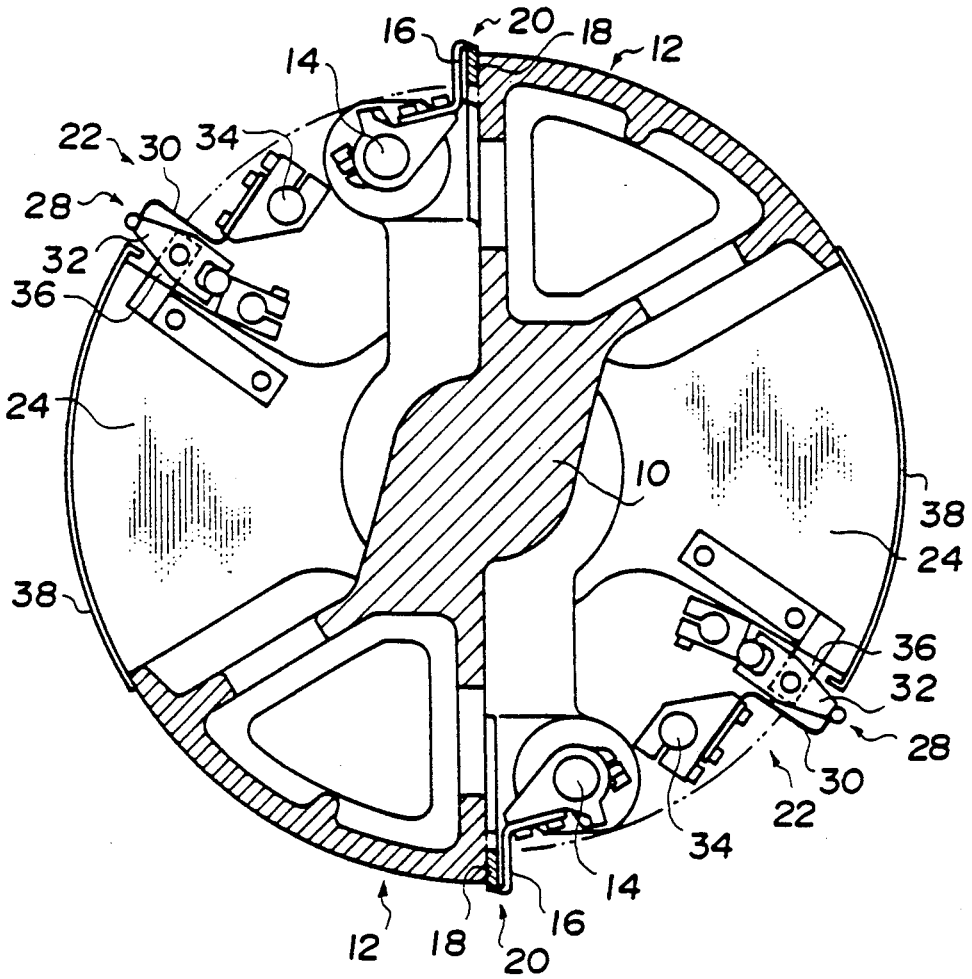
FIG. 4 is a sectional explanatory view showing a sheet dimension adjustment operation.
Figure 5:
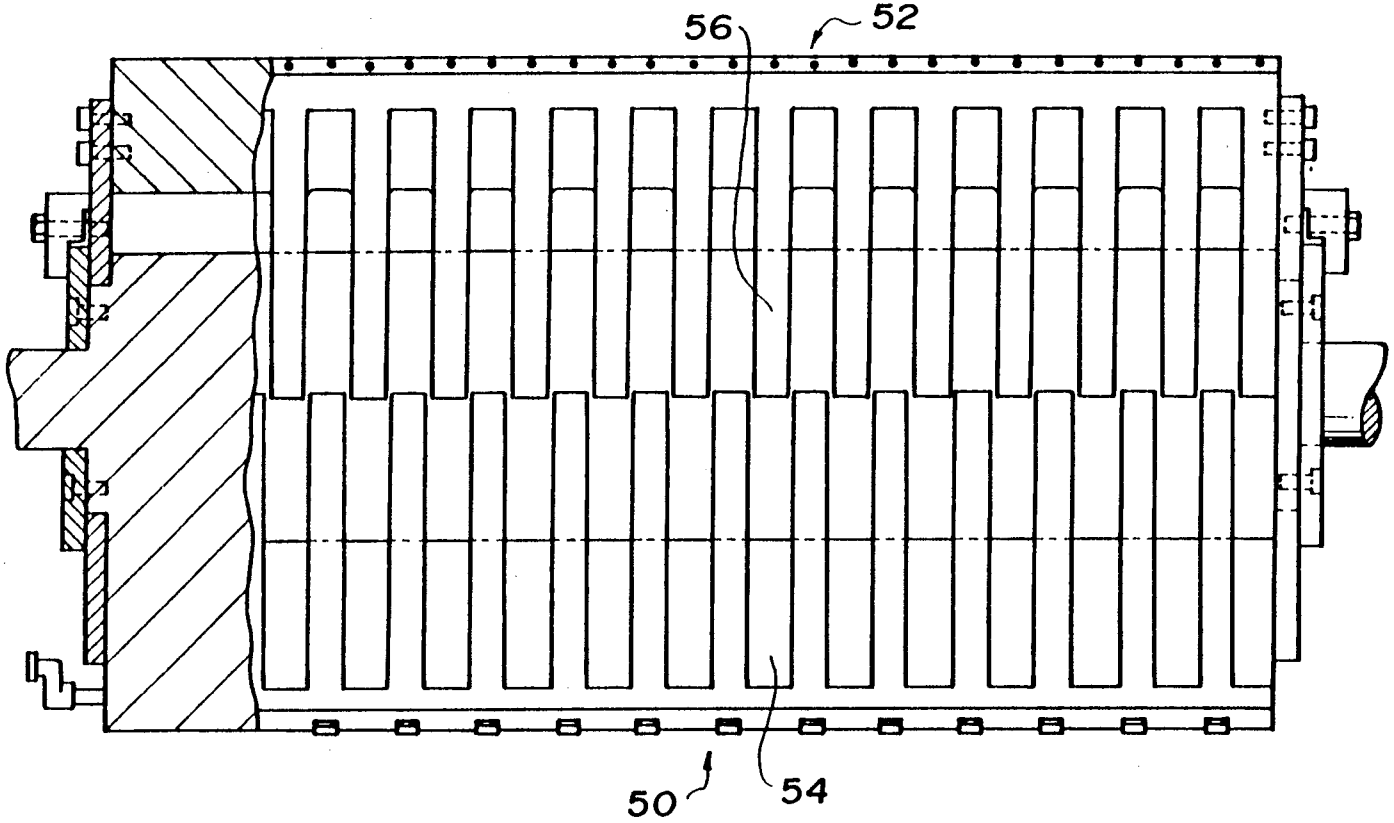
FIG. 5 is a partly exploded plan view showing a prior art.

In the apparatus of the present invention described above, the outer peripheral surface of a composite arc is defined between two sets of front edge gripper group 20 and rear edge gripper group 28 by the outer surface of the front edge gripper holder 12 and the sheet member 38 of the rear edge gripper holder 22, and the sheet of paper is wound around its outer peripheral surface. To adjust the dimension of sheet at the time of printing of both surfaces, coupling between the holding disc 24 and the main shaft 10 is released, and the gap between the front edge gripper group 20 and the rear edge gripper group 28 is so changed as to correspond to the dimension of the sheet by rotating the gear 26 by a suitable phase (see FIG. 4). Thereafter, the holding disc 24 and the main shaft 10 are fastened to each other once again. In the apparatus of the present invention, the position change of the rear edge gripper group 28 can be made under such a simple construction while maintaining the composite arcuate outer peripheral surface.

The intermediate cylinder apparatus of the sheet-feed press according to the present invention provides the following remarkable effects. First, the shapes of the front and rear edge gripper holders 12, 22 are simple and the number of constituent elements is very small. Therefore, the production and assembly adjustment can be made very easily. Second, since the comb-like notches of the prior art do not exist, the end of the sheet does not fall into the notches and a trouble does not occur easily during delivery of the sheet. The secondary effect is as follows. The outer surface of the front edge gripper holder 12 is recessed from the gripper pad 18 and moreover, the sheet member 38 of the rear edge gripper holder 22 can be replaced easily. Accordingly, even if troubles such as jamming of the sheet occur during the transfer of the sheet, recovery of damages can be made easily. Furthermore, surface treatment, such as Teflon coating and sand blasting, can be applied easily to the sheet member 38, so that adhesion of ink can be prevented easily. Furthermore, fine adjustment of relative positions between the A gripper and the B gripper (referred to as "A·B adjustment") can be carried out easily by merely inserting a thin shim into the fitting portion between the holding disc 24 and the sheet member 38.

The present invention is not particularly limited to the embodiment given above but can be expanded and modified in diversified manners.

I claim:

1. An intermediate cylinder of a sheet-feed press comprising:

a main shaft 10;

a front edge gripper holder 12 formed integrally with said main shaft 10, having a group of front edge grippers 20 aligned in an axial direction, and having an arcuate outer surface section;

holding discs 24 disposed at both side portions of said main shaft 10 in such a fashion that the rotation thereof relative to said main shaft 10 can be adjusted; and a rear edge gripper holder 22 having a group of rear edge grippers 28 aligned in the axial direction between said holding discs 24, and having a sheet member 38 disposed similarly on the outer peripheral surface between said holding discs 24, having an arcuate section, and partially overlapping the outer surface of said front edge gripper holder 12.

* * * * *